US010024502B1

(12) United States Patent
Purdy

(10) Patent No.: US 10,024,502 B1
(45) Date of Patent: Jul. 17, 2018

(54) RETROFIT LED LINEAR LAMP LAMPHOLDER FOR LIGHTING FIXTURES

(71) Applicant: ELB ELECTRONICS, INC., Arcadia, CA (US)

(72) Inventor: Steven Purdy, Johns Creek, GA (US)

(73) Assignee: ELB ELECTRONICS, INC., Arcadia, CA (US)

( * ) Notice: Subject to any disclaimer, the term of this patent is extended or adjusted under 35 U.S.C. 154(b) by 0 days.

(21) Appl. No.: 15/589,907

(22) Filed: May 8, 2017

(51) Int. Cl.

| | |
|---|---|
| ***F21V 21/00*** | (2006.01) |
| ***F21K 9/272*** | (2016.01) |
| ***F21K 9/275*** | (2016.01) |
| ***F21S 4/28*** | (2016.01) |
| ***F21S 8/04*** | (2006.01) |
| *F21Y 115/10* | (2016.01) |

(52) U.S. Cl.
CPC ..... *F21K 9/272* (2016.08); *F21K 9/275* (2016.08); *F21S 4/28* (2016.01); *F21S 8/04* (2013.01); *F21Y 2115/10* (2016.08)

(58) Field of Classification Search
CPC .. F21K 9/272; F21K 9/275; F21S 8/04; F21S 4/28; F21Y 2115/10
See application file for complete search history.

(56) References Cited

U.S. PATENT DOCUMENTS

| | | | | |
|---|---|---|---|---|
| 8,434,891 | B1 * | 5/2013 | Ham | F21V 23/06 362/218 |
| 2009/0280695 | A1 * | 11/2009 | Sekela | F21V 21/002 439/699.2 |
| 2011/0235319 | A1 * | 9/2011 | Fukano | F21V 23/06 362/217.14 |
| 2012/0106157 | A1 * | 5/2012 | Simon | F21V 25/04 362/249.05 |
| 2012/0195032 | A1 * | 8/2012 | Shew | H02J 9/065 362/183 |
| 2014/0029247 | A1 * | 1/2014 | Gielen | F21V 19/008 362/217.13 |
| 2015/0198291 | A1 * | 7/2015 | Lin | F21K 9/175 362/217.13 |
| 2015/0276140 | A1 * | 10/2015 | Demuynck | F21K 9/175 362/223 |

* cited by examiner

*Primary Examiner* — Donald Raleigh
(74) *Attorney, Agent, or Firm* — Karish & Bjorgum, PC

(57) ABSTRACT

A retrofit LED linear lamp lampholder for use with LED linear lamps having two terminal ends and used in lighting fixtures having spaced apart opposing end walls. The retrofit LED linear lamp lampholder has a pair of endcaps, each endcap having a first end that fits on one of the terminal ends of a LED linear lamp, and a second end with an engagement mechanism that is adapted to contact with one of the end walls of the lighting fixture. In at least in one of the endcaps there is a movement mechanism for moving said second end of said at least one endcap away from its associated terminal end of LED linear lamp. For use with conventional LED linear lamps with electrical pins at terminal ends, there are electrical contacts in of the endcaps having LED linear lamp energizing lead wires that exit the endcaps.

25 Claims, 7 Drawing Sheets

RETROFIT LED LINEAR LAMP LAMPHOLDER FOR LIGHTING FIXTURES

FIELD OF THE INVENTION

The invention relates to lighting and more particularly to length adjustment adapters for LED linear lamps to allow LED linear lamps to replace fluorescent linear lamps in fluorescent linear lamp lighting fixtures.

BACKGROUND OF THE INVENTION

Fluorescent linear lamps are widely used in office, retail and manufacturing, repair shop environments, and other settings, and typically fit into lighting fixtures with rectangular sheet metal boxes that have socket lamp holders at opposite ends thereof to retain and energize the fluorescent linear lamps. Fluorescent linear lamps have numerous shortcomings including generally poor light color quality, sometimes noisy operation, relatively high energy consumption, inclusion of toxic mercury (which makes disposal of fluorescent linear lamps problematic), and relatively short lifespans. In contrast, LED linear lamps can be designed to have any desired light color (measured in Kelvins), are quiet, are more energy efficient, do not include toxic mercury, and last a long time with operations of up to 50,000 hours (versus 10,000 for conventional fluorescent linear lamps.)

When they were first introduced, LED linear lamps were much more costly than fluorescent linear lamps. With prices down significantly, it now makes sense to install LED linear lamps for new construction instead of fluorescent linear lamps. However, in cases of retrofit applications where fluorescent linear lamp light fixtures are already installed, updating fluorescent linear lamp fixtures to accommodate LED linear lamps is not always easy, convenient, or cost effective when considering union electrician labor rates. For example, in some situations the fluorescent linear lamp light fixture may have a light box that is slightly larger or smaller than is typical, the light fixture may be outfitted with old ballasts, or the fluorescent linear lamp light fixture may be designed to hold 2 or 4 parallel fluorescent linear lamps whereas the user wishes to use a different number of LED linear lamps therein. Also, many of the existing fixtures have old or damaged lamp sockets which need replacing when using traditional lamps with bi-pin ends to reduce risk of arcing or intermittent problems in the future. So, when converting to LED lamps changing the lamp sockets is costly in time and materials. As will be described further below, the invention allows installation of the LED lamp into the existing light fixture without the use of traditional lamp sockets. The existing sockets can be removed and the LED lamp installed easily and quickly.

There are currently available kits for converting fluorescent linear lamp light fixtures to work with LED linear lamp. For example, with the Everline Dimmable 21.6 W 4000K 2'×2' LED Retrofit Kit, each LED linear bulb is incorporated into its own LED lensed modules/light bar. The LED lensed modules/light bars need to be screwed (with self-tapping screws) to the back wall of the light fixture and then wires therefrom will be connected to a light control module that will replace the fluorescent light ballast.

In the Litetronics® LED troffer retrofit kit, three LED linear lamps come preinstalled and spaced apart on a rack. The rack will be screwed to the back wall of the light fixture. However, this design is bulky to ship and can be relatively costly. Moreover, it does not allow customization by the user to change the number of the LED linear lamps.

There accordingly remains a need for adapters to allow custom or standard LED linear lamps to standard LED linear lamps in lighting fixtures originally outfitted with fluorescent linear lamps.

SUMMARY OF THE INVENTION

The present invention provides a retrofit LED linear lamp lampholder for use with LED linear lamps having two terminal ends and used in lighting fixtures having spaced apart opposing end walls, the retrofit LED linear lamp lampholder comprising; a pair of endcaps, each endcap having a first end that fits on one of the terminal ends of a LED linear lamp and a second end that is spaced away from the first end; and an engagement mechanism at the second ends of the endcaps, which engagement mechanism will aid in retaining the endcaps into contact with the spaced apart opposing end walls of the lighting fixture to thereby retain the associated LED linear lamp in place in the lighting fixture.

In another embodiment of the invention, there is provided a retrofit LED linear lamp lampholder for use with LED linear lamps having two terminal ends and used in lighting fixtures having spaced apart opposing end walls, the retrofit LED linear lamp lampholder comprising: a pair of endcaps, each endcap having a first end that fits on one of the terminal ends of a LED linear lamp and a second end that is adapted to contact with one of the end walls of the lighting fixture, and an engagement mechanism at the second ends of the endcaps, which engagement mechanism will aid in retaining the endcaps into contact with the spaced apart opposing end walls of the lighting fixture to thereby retain the associated LED linear lamp in place in the lighting fixture.

In yet a further embodiment, there is provided a retrofit LED linear lamp lampholder for use with LED linear lamps having two terminal ends and used in lighting fixtures having spaced apart opposing end walls, the retrofit LED linear lamp lampholder comprising: a pair of endcaps, each endcap having a first end that fits on one of the terminal ends of a LED linear lamp, the first end having electrical contacts that connect with electrical pins on the LED linear lamp and the electrical contacts having lead wires that exit the endcaps, and a second end that is adapted to contact with one of the end walls of the lighting fixture; and in at least in one of the endcaps, a movement mechanism for moving said second end of said at least one endcap away from its associated terminal end of LED linear lamp.

These and other features of the invention are described below.

DETAILED DESCRIPTION

Figure 1:
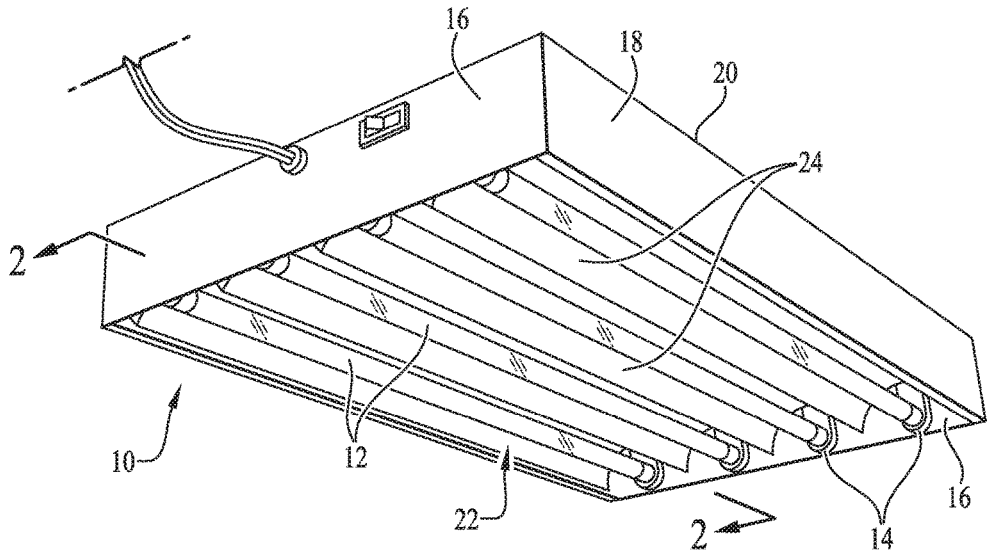
FIG. 1 is a perspective view showing a prior art rectangular florescent light fixture with four conventional florescent light bulbs installed.

Turning first to FIG. 1, there is shown a perspective view showing a prior art rectangular florescent light fixture 10 with four conventional florescent linear light bulbs 12 installed by electrical and mechanical engagement with sockets 14 located near the inside of the spaced apart opposing end walls 16. The end walls 16 are joined by side walls 18 and form a rectangular open box with a back wall 20. The rectangular florescent light fixture 10 is shown without a light diffuser covering the front of the open front 22 thereof. The ballasts to power the florescent linear light bulbs 12 are located behind ballast covers 24 that are affixed to the back wall 20.

Figure 2:
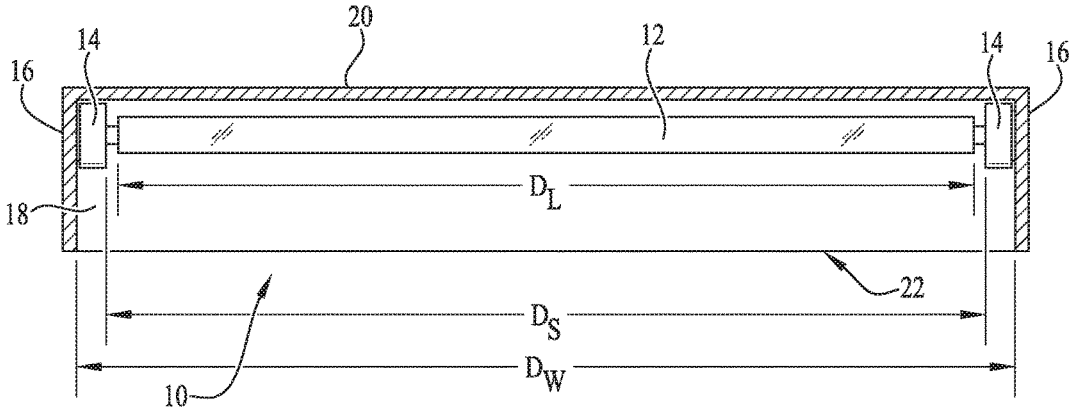
FIG. 2 is a cross-sectional view through view lines 2-2 of FIG. 1 of the rectangular florescent light fixture with a conventional florescent light bulb shown.

Referring to FIG. 2, there is shown a cross-sectional view along view lines 2-2 of FIG. 1 of the rectangular florescent light fixture 10 showing one florescent linear light bulb 12 connected to two florescent linear light bulb sockets 14. The florescent linear light bulbs 12 have a length of $D_L$. The florescent linear light bulb sockets 14 are spaced apart by a distance $D_S$, and the spaced apart end walls 16 are spaced apart by distance $D_W$, wherein $D_L<D_S<D_W$. As is clear from FIG. 2, the florescent linear light bulbs 12 are shorter than the inner distance $D_W$ between the spaced apart end walls 16.

In the U.S. and in most industrialized countries, common standards prevail that determine sizes and other particulars of electrical devices including fluorescent linear lamps, LED linear lamps, and the sockets and standard cabinets dimensions for same. These standards, such as ANSI (American National Standards Institute), help ensure that parts made by different manufactures will fit and work together without modification and without fail. Thus, when a consumer buys a standard four foot long fluorescent linear lamp or LED linear lamps he/she can be confident that it will fit into light fixture designed for four foot lamps. Indeed, because manufacturers of fluorescent linear lamp and/or LED linear lamp fixtures (e.g., the rectangular fixture 10 of FIG. 1) wish to source parts from a variety of different parts suppliers, the fluorescent linear lamp and/or LED linear lamp sockets (e.g., the florescent linear light bulb sockets 14 of the rectangular fixture 10 of FIG. 1) vary little in size, and are typically about ¼" to about 5/16" thick. Thus, referring back to FIG. 2, for a rectangular fixture 10 that fits 4 foot long fluorescent linear lamps or and/or LED linear lamps, $D_L$=4 feet, $D_S$=about 4 feet ⅛", and $D_W$=about 4 feet and ⅝"~4 feet and ¾".

Figure 3A:
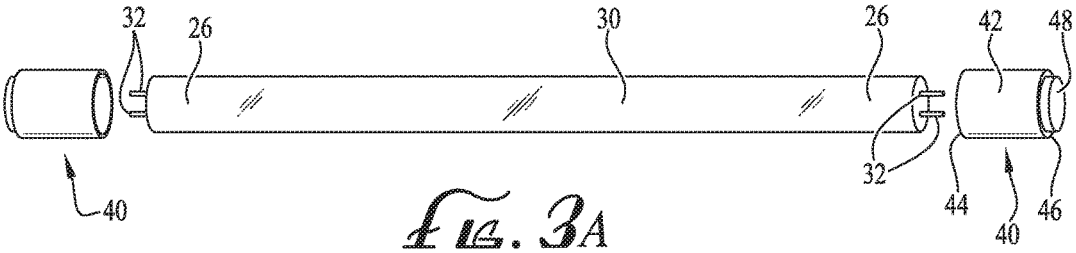
FIG. 3A is a side view showing a LED linear lamp with two terminal ends with energizing pins, and with an exemplary embodiment of two endcaps of the invention prior to being fitted onto the terminal ends of the LED linear lamp.
Figure 3B:
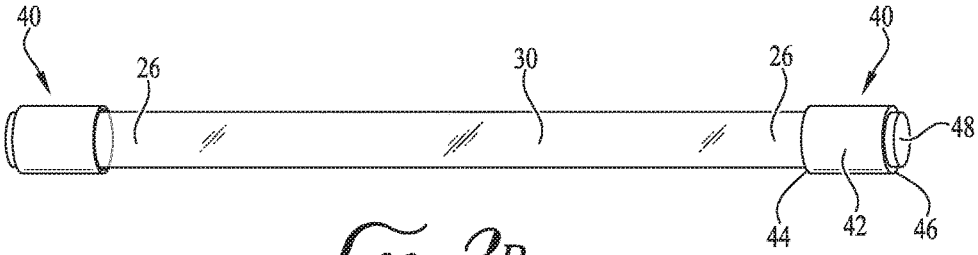
FIG. 3B is side view showing a LED linear lamp and the endcaps of FIG. 3A with the endcaps fitted on the terminal ends and energizing pins of the LED linear lamp.
Figure 4:
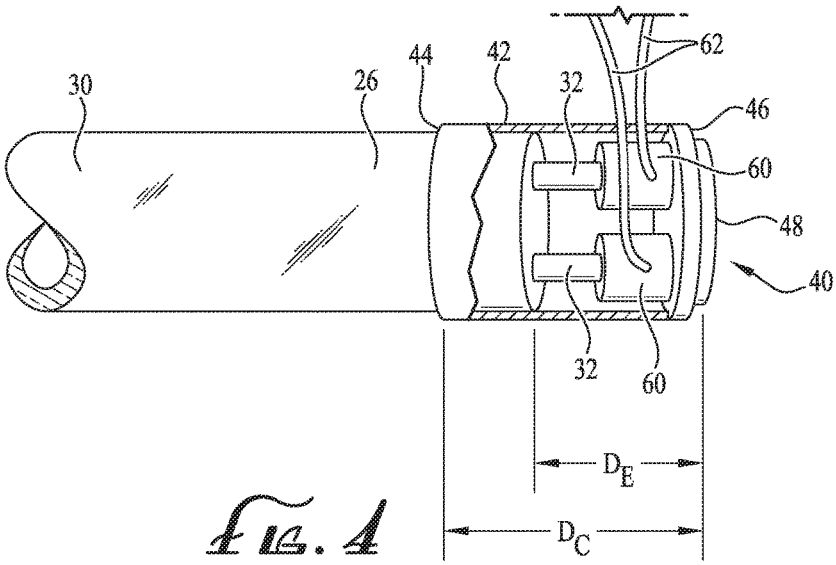
FIG. 4 is a partially exposed side view of one endcap of FIG. 3A fitted onto a terminal end of the LED linear lamp of FIG. 3B.

FIG. 3A is a front view showing a LED linear lamp 30 with two terminal ends 26 with energizing pins 32, and with exemplary embodiments of two endcaps 40 of the invention prior to being fitted onto terminal ends 26 of the LED linear lamp 30, and FIG. 3B shows the endcaps 40 after being fitted onto terminal ends 26 of the LED linear lamp 30. The endcaps 40 each have a first open end 44 that is adapted to fit over the terminal end 26 of the LED linear lamp 30 and a second end 46 spaced away from the first end 44. In one embodiment, the endcaps 40 may be slide over terminal ends 26 of the LED linear lamp 30 and is designed to snuggly fit thereon. The endcaps 40 have a sidewall 42 and the endcaps 40 preferably have an axial bore extending inwardly from the first open end 44 toward the second end 46, which is closed. In most applications, LED linear lamps 30 have a generally cylindrical shape and the endcaps may be generally cylindrical in shape and be sized such that inner bore fits the terminal ends 26 with the inner surfaces of the sidewall 42 conforming to the terminal ends 26 of the LED linear lamp 30. Referring to FIG. 4, inside the endcaps 40 are electrical contacts 60 that make electrical contact with the energizing pins 32. Electrical lead wires 62 are connected to the electrical contacts 60 and are used to energize the LED linear lamp 30. Located at the second ends 46 of the endcaps 40 are engagement mechanism 48. The engagement mechanism 48 can, for example, be a permanent magnet, a piece of non-slip pad material such as rubber or plastic, and/or a section of self-stick adhesive pad material. The endcaps 40 have a length of $D_C$ and when placed on the terminal end 26 of the LED linear lamp 30 will extend the length of the LED linear lamp 30 at that end by a distance $D_E$ (including the thickness of the engagement mechanism 48.)

Figure 5A:
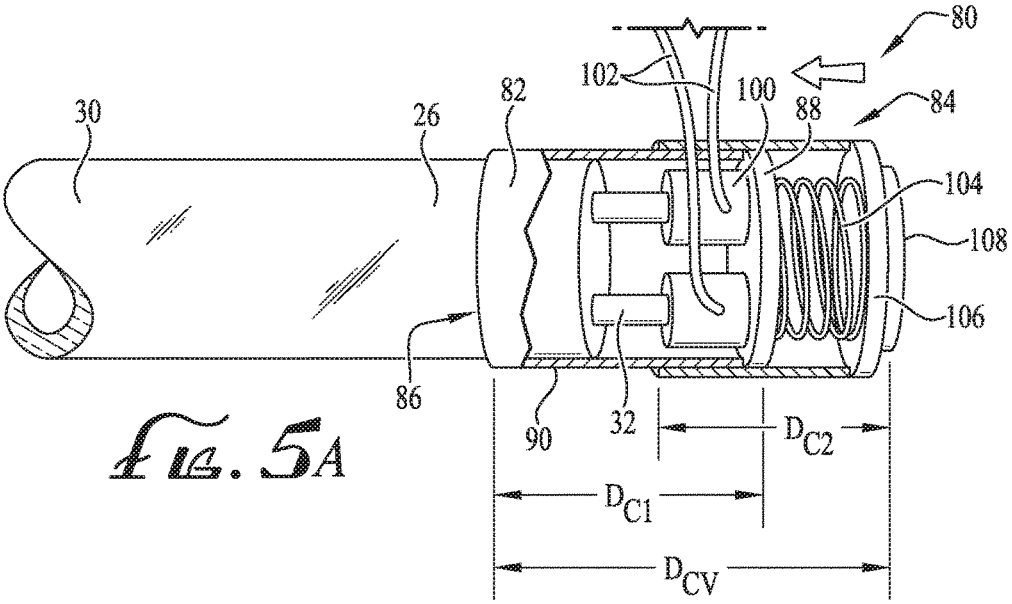
FIG. 5A is an exposed side view showing another exemplary embodiment of a two piece endcap of the invention fit onto a LED linear lamp with energizing pins, with the terminal piece pushed inwardly towards its LED lamp engaging portion to shorten a working length of the two piece endcap.
Figure 5B:
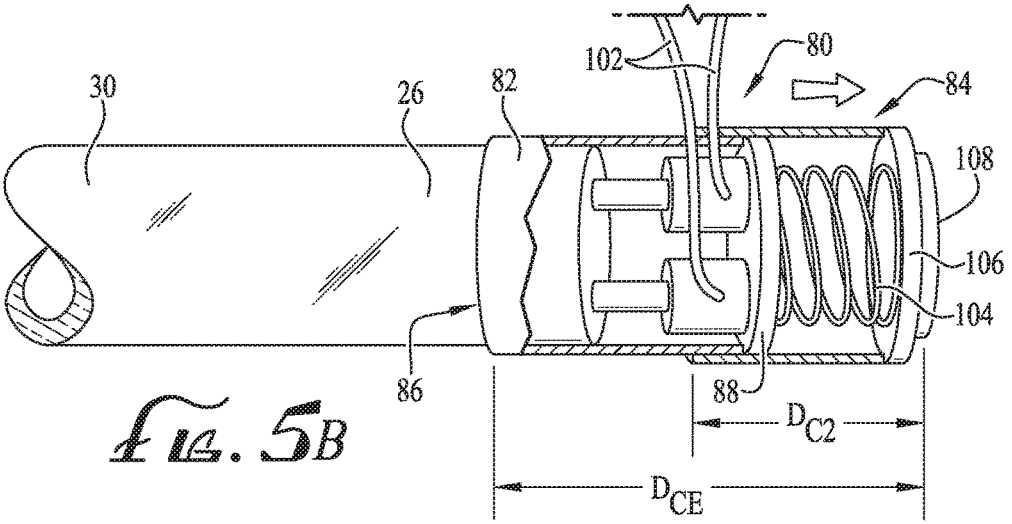
FIG. 5B is an exposed view showing the two piece endcap of FIG. 5A but with the terminal piece biased by a spring away from its LED lamp engaging portion to lengthen a working length of the two piece endcap.

FIG. 5A is an exposed side view showing another exemplary embodiment of a two piece endcap 80 of the invention with a first portion 82 and a second portion 84, with the first portion 82 fit onto a terminal end 26 of a LED linear lamp 30 with energizing pins 32, and with the second portion 84 pushed inwardly towards the first portion 82. FIG. 5B is the same view, but with the second portion 84 biased further away from the first portion 82. Like the endcap of FIG. 4, the first portion 82 has a first open end 86 that is adapted to tightly fit over one of the terminal end 26 of the LED linear lamp 30 and has a second closed end 88 spaced away from the first open end 86. The first portion 82 has a sidewall 90 and the first portion 82 has an axial bore extending inwardly from the first open end 86 toward its second end 88, which is closed. Thus, the sidewall 90 of the first portion 82 of the endcap 80 fits over the terminal end 26 of the LED linear lamp 30, as is shown in FIGS. 5A and 5B. Still referring to FIGS. 5A and 5B, inside the first portion 82 of the endcaps 80 are electrical contacts 100 that make electrical contact with the energizing pins 32. Electrical lead wires 102 are connected to the electrical contacts 100 and are used to energize the LED linear lamp 30 through the pins 32. The second portion 84 is in the form of a slightly larger cap that is can freely slide over the outside of the first portion 82, which is itself cap-shaped. A biasing mechanism, such as a spring 104 is placed inside the second portion 84. The spring bears on the second end 88 of the first portion 82 and a terminal end 106 of the second portion 84, thereby tending to push the second portion 84 away from the first portion 82. An engagement mechanism 108 if located on the terminal end 106. The engagement mechanism 108 can, for example, be a permanent magnet, a piece of non-slip pad material such as rubber or plastic, and/or a section of self-stick adhesive pad material. The first portion has a length $D_{C1}$ and the second portion (including the engagement mechanism 108) has a length $D_{C2}$. When the second portion 84 is pushed inwardly toward the first portion 82 as shown in FIG. 5A, the spring 104 will be under additional tension, and the working length of the endcap 80 will be $D_{CU}$. Without the second portion 84 being pushed in, however, the working length will be $D_{CE}$, wherein $D_{CE}>D_{EU}$. Thus, the endcap 80 has the ability to lengthen by a distance of $D_{CE}$-$D_{EU}$, which preferably equality about ⅛" to about ½".

Figure 6:
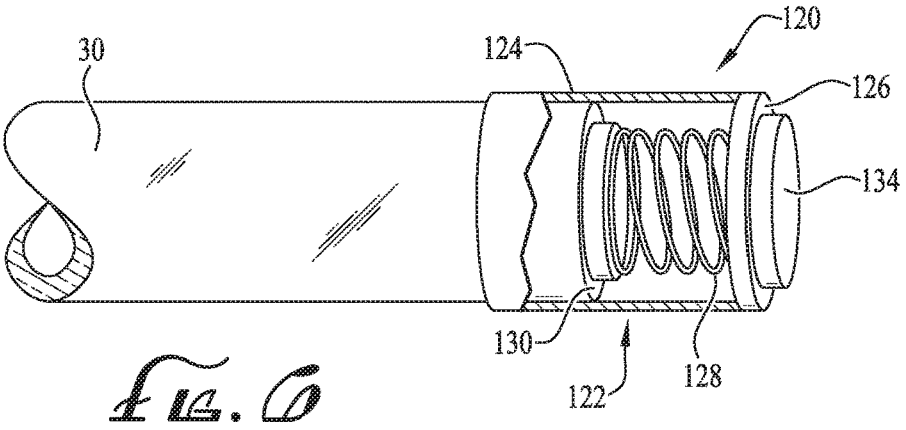
FIG. 6 is an exposed side view showing another exemplary embodiment of an endcap of the invention fit onto a LED linear lamp without energizing pins.

FIG. 6 is an exposed side view showing another exemplary embodiment of an endcap 120 of the invention fit onto a LED linear lamp 30 without energizing pins. In this design, there is a single cap-shaped portion 122 with sidewalls 124 and an end wall 126. A biasing mechanism 128 (such as a spring) is located inside the cap-shaped portion 122 and rides at one end against a terminal end 130 of the LED linear lamp 30, and at its other end against the end wall 126 of the cap-shaped portion 122. The biasing mechanism 128 biases the cap-shaped portion 122 outwardly away from the terminal end 130 of the LED linear lamp 30 and thus provides a biasing force that tends to help a LED linear lamp 30 and its endcaps 120 be self-clamped in place between two opposite side walls of a light fixture (in the matter of FIGS. 13 and 14) with the pressure of the biasing mechanism 128 aiding in the retention. An engagement mechanism 134 is positioned on the end wall 126, and can be, for example, a permanent magnet, a piece of non-slip pad material such as rubber or plastic, and/or a section of self-stick adhesive pad material. Most linear light fixture cabinets are made of ferrous sheet metal so that when a permanent magnets are used as the engagement mechanisms 134, the additional magnetic attractive force provided by the permanent magnets will permanently retain the cap-shaped portions 122 and their carried LED linear lamp in place, even when the spring force of the biasing mechanisms 128 is not great. Indeed, if magnets are used, it may not even been necessary to include biasing mechanisms inside the cap-shaped portions 122.

Figure 7:
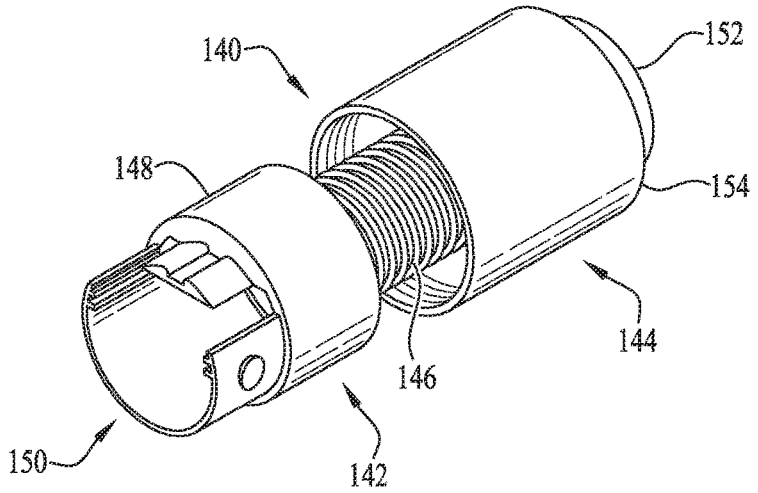
FIG. 7 is a front perspective view showing an embodiment of another two-piece spring joined adjustable length endcap of the invention for use with a specialized LED linear lamp.

FIG. 7 is a front perspective view showing an exemplary embodiment of two-piece spring joined adjustable length endcap 140 of the invention for use with a specialized LED linear lamp (not shown.) In this embodiment, the two-piece spring joined adjustable length endcap 140 includes a first portion 142 and a second portion 144, joined together by a biasing mechanism 146, shown here as a coil spring. The second portion has 144 a larger diameter and can slide over the outside of the first portion 142 when the coil spring 146 is compressed. The first portion 142 has a collar end 148 and an engagement end 150 designed to snap into a specialized LED linear lamp. An engagement mechanism 152 (which can be the same or similar as the engagement mechanisms 48 and 108 described above) is located at a terminal end 154 of the second portion 144.

Figure 8:
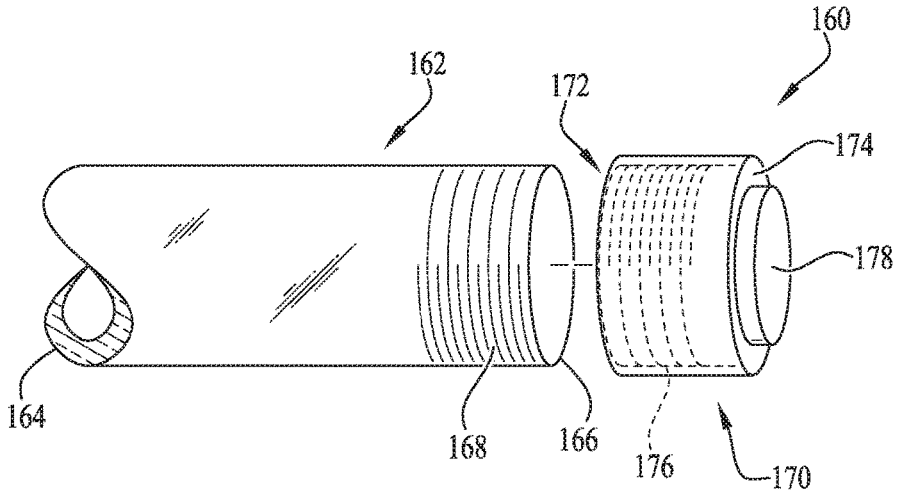
FIG. 8 is a partially exposed side view showing an exemplary embodiment of two-piece screw together adjustable length endcap of the invention for use with conventional LED linear lamp with energizing pins.

FIG. 8 is a front view showing an exemplary embodiment of two-piece screw together adjustable length endcap 160 of the invention for use with conventional LED linear lamp with energizing pins (not shown.) This endcap has a first portion 162 with a first end 164 and a second end 166. External threads 168 are formed near the second end 166. The endcap also has a second portion 170 that is cap-shaped, with an open first end 172 and a closed second end 174. Internal threads 176 are formed inside the second portion 170, which internal threads 176 are adapted to engage with the external threads 168 of the first portion 162 when the second portion 170 is screwed onto the first portion 162. Depending on the degree to which the second portion 170 is screwed onto the first portion 162, the overall length of the endcap 160 can be changed by a user. An engagement mechanism 178 (which can be the same or similar as the engagement mechanisms 48, 108, 134, and 152 described above) is preferably located at the closed second end 174 of the second portion 170.

Figure 9A:
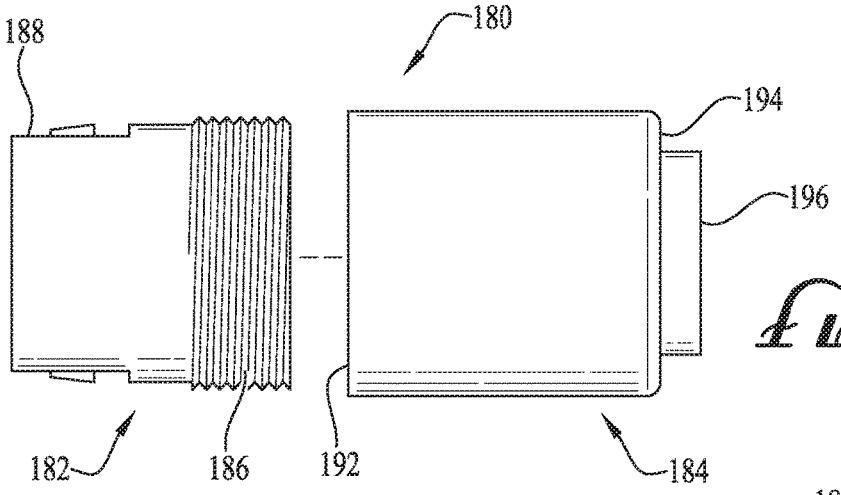
FIG. 9A is a side view showing an exemplary embodiment of two-piece threaded together adjustable length endcap of the invention for use with a specialized LED linear lamp.
Figure 9B:
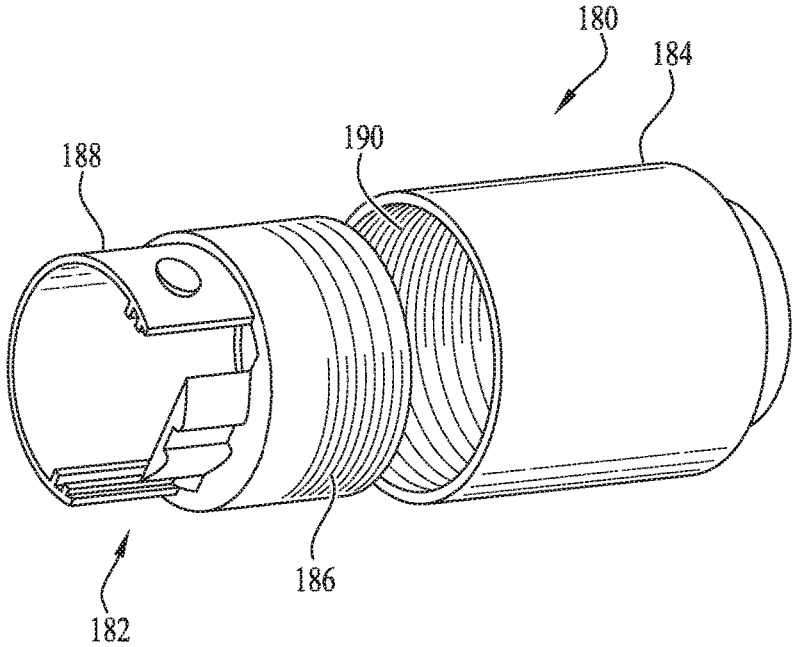
FIG. 9B is a perspective view showing the exemplary two-piece threaded together adjustable length endcap of FIG. 9A.

FIG. 9A is a side view and FIG. 9B is a perspective view showing an exemplary embodiment of two-piece threaded together adjustable length endcap 180 of the invention for use with a specialized LED linear lamp (not shown.) In this embodiment, the two-piece threaded together adjustable length endcap 180 includes a first portion 182 and a second portion 184. The first portion 182 has an externally threaded second end 186 and a specialized LED linear lamp connector end 188. The second portion is generally cap-shaped with internal threads 190 formed in its open front end 192. The terminal end 194 is closed, and has an engagement mechanism 196 positioned there, much as described above with the other endcap embodiments of the invention. Depending on the degree to which the second portion 184 is screwed onto the first portion 182, the overall length of the endcap 180 can be changed by a user.

Figure 10:
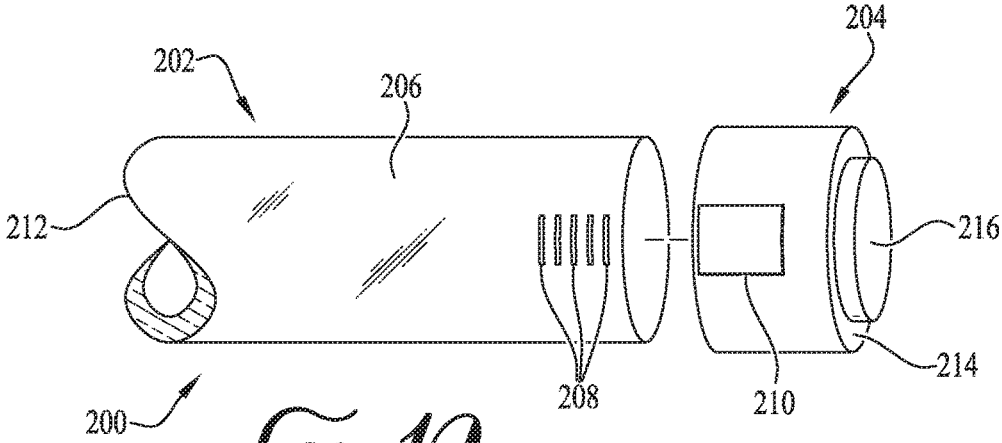
FIG. 10 is a side view showing an exemplary embodiment of two-piece racket adjustable length endcap of the invention.

FIG. 10 is a side view showing another exemplary embodiment of two-piece racket adjustable length endcap 200 of the invention, which has a first portion 202 and a second portion 204. The first portion is generally cylindrical and has a sidewall 206 with a series of parallel and spaced apart slots 208 formed thereon. The second portion 204 is generally cap-shaped and has a spring loaded arm 210 that will provide a racket connection between the first portion and second portion and maintain the axial position of the second portion 204 relative to the first portion 202 to allow a working length of the endcap 200 between a first end 212 of the first portion 202 and a terminal end 214 of the second portion 204 to be adjusted as desired by a user. The terminal end 214 is closed, and has an engagement mechanism 216 positioned there, much as described above with the other endcap embodiments of the invention.

Figure 11:
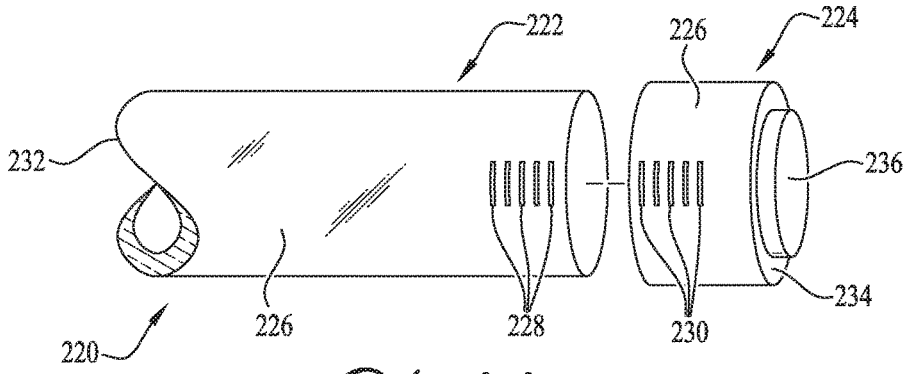
FIG. 11 is a side view showing an exemplary embodiment of another two-piece racket adjustable length endcap of the invention.

FIG. 11 is a side view showing an exemplary embodiment another two-piece racket adjustable length endcap 220 of the invention, which has a first portion 222 and a second portion 224. The first portion is generally cylindrical and has a sidewall 226 with a series of parallel and spaced apart ridges 228 formed thereon. The second portion 224 is generally cap-shaped and has a side wall 226 with a series of parallel and spaced apart slots 230 formed therein, the slots 230 being sized and shaped to releasably catch one or more of the ridges 228 with the second portion 224 is slide over the first portion 222. Thus, there will be provided a racket connection between the first portion 222 and second portion 224 and maintain the axial position of the second portion 224 relative to the first portion 222 to allow a working length of the endcap 220 between a first end 232 of the first portion 222 and a terminal end 234 of the second portion 224 to be adjusted as desired by a user. The terminal end 234 is closed, and has an engagement mechanism 236 positioned there, much as described above with the other endcap embodiments of the invention. As with other embodiments of the endcaps of the invention, the endcap is designed to fit over a terminal end of a LED linear bulb to provide adjustable lengthening of same to that the LED linear bulb fitted with endcaps of the invention will snuggly fit in and be retained in a light fixture.

Figure 12:
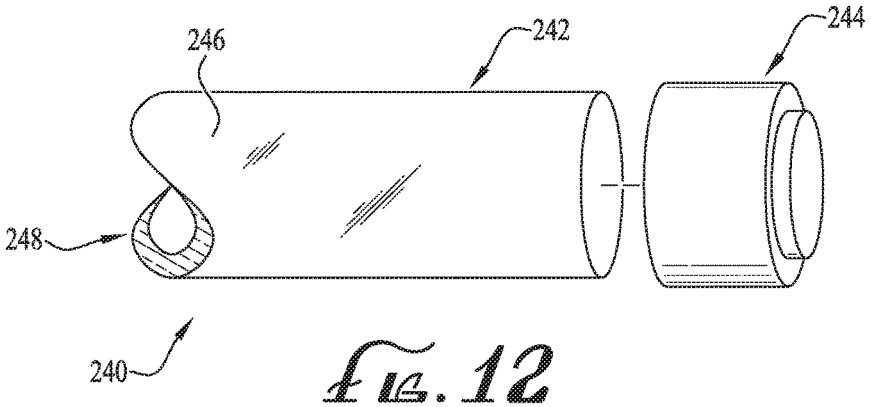
FIG. 12 is a side view showing an exemplary embodiment of a press fit two-piece adjustable length endcap of the invention.

FIG. 12 is a side view showing an exemplary embodiment of a press fit two-piece adjustable length endcap 240 of the invention. It has a first portion 242 and a second portion 244. The first portion 242 is generally cylindrical and has a smooth sidewall 246. The first portion 242 has a first open mouth 248 that fits over a terminal end of a LED linear lamp (not shown), as is the case with other embodiments of the endcaps. The second portion 244 is generally cap-shaped and is designed to snuggly fit over the first portion 242 with some friction. The second portion 244 has terminal end 246 which is closed, and has an engagement mechanism 248 positioned thereon, much as described above with the other endcap embodiments of the invention. As with other embodiments of the endcaps of the invention, the two piece endcap 240 is designed to fit over a terminal end of a LED linear bulb to provide adjustable lengthening of same to that the LED linear bulb fitted with endcaps of the invention will snuggly fit in and be retained in a light fixture.

Figure 13:
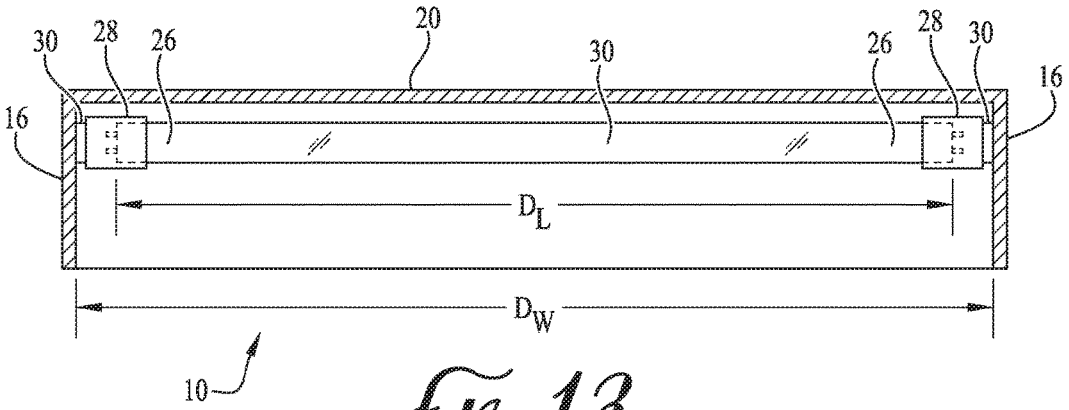
FIG. 13 is a cross-sectional view of the rectangular florescent light fixture of FIGS. 1 and 2 but with the florescent light bulb sockets removed and with a LED linear lamp installed with endcaps of the invention retaining the LED linear lamp in place therein.
Figure 14:
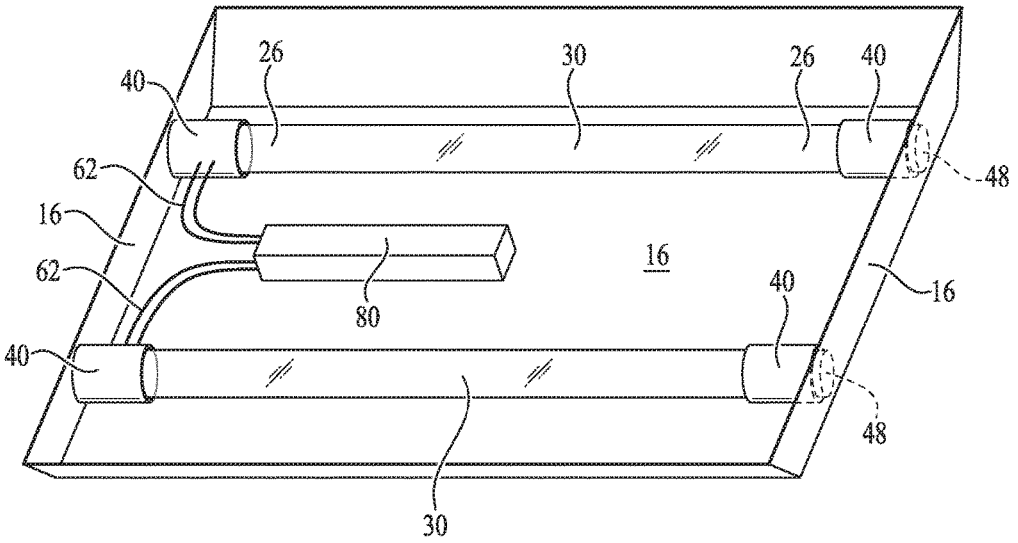
FIG. 14 is diagrammatic perspective view showing two LED linear lamp installed with endcaps of the invention retaining the LED linear lamps in place in a rectangular fluorescent light fixture.

FIG. 13 is a cross-sectional view of the rectangular florescent light fixture of FIGS. 1 and 2 but with the florescent light bulb sockets (shown as 14 in FIGS. 1 and 2) removed and with a LED linear lamp 30 installed with endcaps 28 of the invention retaining the LED linear lamp 30 in place in a rectangular fluorescent light fixture 10 between the end walls 16 thereof. FIG. 14 is diagrammatic perspective view showing two LED linear lamp installed with endcaps of the invention retaining the LED linear lamps in place in a rectangular fluorescent light fixture.

As best shown in FIGS. 13 and 14, when the endcaps 40 are on the second ends 46 of the engagement mechanisms 48 will aid in retaining the endcaps 40 and their carried LED linear lamp 30 into contact with the inside of the spaced apart opposing end walls 16 of the lighting fixture 10 to thereby retain the associated LED linear lamp in place in the lighting the lighting fixture 10. As shown in FIG. 14, the electrical lead wires 62 exit the endcaps 40 are connected to a LED linear lamp driver unit 80 which is affixed (e.g. with screws to the back wall 20 of the light fixture 10.

As has been described above, the various embodiments of endcaps of the invention provide for adjustable lengthening of the LED linear lamp to allow both conventional LED linear lamps (e.g., with energizing pins) and specialized, prewired LED linear lamps to be used in existing fluorescent linear lamp fixture boxes 10. Indeed, the endcaps will make up for the space lost by removing the florescent linear light bulb sockets 14 in the in existing fluorescent linear lamp fixture boxes 10, and to the extent that the endcaps include a biasing force, additional engagement with the side walls 16 of the fixture 10. It is likewise possible that instead of using two identical endcaps for each LED linear lamps, one stationary endcap can use used that leaves out the length adjustability feature and the other endcap can include such endcap length adjustability feature. Furthermore, it is possible that the engagement mechanism can include some length adjustability to the endcap. For example, the engagement mechanism can comprise thick enough resilient foam material with a magnet at its terminal end away from the endcaps to make up necessary space in the light fixture cabinet.

The preferred embodiments of this invention have been disclosed, however, so that one of ordinary skill in the art would recognize that certain modifications would come within the scope of this invention.

What is claimed is:

1. A retrofit LED linear lamp lampholder for use with LED linear lamps having two terminal ends and used in lighting fixtures having spaced apart opposing end walls, the retrofit LED linear lamp lampholder comprising:

a pair of endcaps, each endcap having a first end that fits on one of the terminal ends of a LED linear lamp and a second end that is spaced away from the first end; and an engagement mechanism at the second ends of the endcaps, which engagement mechanism will aid in retaining the endcaps into contact with the spaced apart opposing end walls of the lighting fixture to thereby retain the associated LED linear lamp in place in the lighting fixture.

2. The retrofit LED linear lamp lampholder of claim 1, wherein the first ends of the endcaps slideably fit over the terminal ends of the LED linear lamp.

3. The retrofit LED linear lamp lampholder of claim 1, further comprising a movement mechanism for moving said second end of at least one endcap away from its associated terminal end of LED linear lamp.

4. The retrofit LED linear lamp lampholder of claim 3, wherein the movement mechanism is located in said at least one endcap and wherein at least one endcap movably fits on the terminal end of LED linear lamp.

5. The retrofit LED linear lamp lampholder of claim 3, wherein the movement mechanism comprises a spring.

6. The retrofit LED linear lamp lampholder of claim 5, wherein the spring is position inside the endcap and biases the second end of said at least one endcap away from its associated terminal end of LED linear lamp.

7. The retrofit LED linear lamp lampholder of claim 5, wherein the spring is selected from the group consisting of a coil spring and a bowed spring.

8. The retrofit LED linear lamp lampholder of claim 1, wherein the endcaps further comprises electrical contacts located in the endcaps which electrical contacts make contact with electrical pins on the LED linear lamp, the electrical contacts of the endcaps having lead wires that extend from the endcaps.

9. The retrofit LED linear lamp lampholder of claim 8, wherein the endcaps are press fit over terminal ends of the LED linear lamp.

10. The retrofit LED linear lamp lampholder of claim 1, wherein the engagement mechanism at the second ends of each endcap is selected from the group consisting of a magnet, non-slip pad material, and self-stick adhesive pads.

11. The retrofit LED linear lamp lampholder of claim 1, wherein the endcaps each comprise a first portion and a second portion, the first portion and second portion being movable relative to each other, the first portion comprising the first end that fits on one of the terminal ends of the LED linear lamp, and the second portion comprising the second end that has the engagement mechanism.

12. The retrofit LED linear lamp lampholder of claim 11, wherein the second portion moves outwardly away from first portion by a threading mechanism consisting of threads formed on the first portion and second portion.

13. The retrofit LED linear lamp lampholder of claim 11, wherein the second portion moves outwardly away from first portion by a racket mechanism.

14. The retrofit LED linear lamp lampholder of claim 11, wherein the second portion moves outwardly away from first portion by a biasing mechanism.

15. A retrofit LED linear lamp lampholder for use with LED linear lamps having two terminal ends and used in lighting fixtures having spaced apart opposing end walls, the retrofit LED linear lamp lampholder comprising:

a pair of endcaps, each endcap having a first end that fits on one of the terminal ends of a LED linear lamp and a second end that is adapted to contact with one of the end walls of the lighting fixture, and an engagement mechanism at the second ends of the endcaps, which engagement mechanism will aid in retaining the endcaps into contact with the spaced apart opposing end walls of the lighting fixture to thereby retain the associated LED linear lamp in place in the lighting fixture.

16. The retrofit LED linear lamp lampholder of claim 15, further comprising an engagement mechanism at the second ends of the endcaps, which engagement mechanism will aid in retaining the endcaps into contact with the spaced apart opposing end walls of the lighting fixture to thereby retain the associated LED linear lamp in place in the lighting fixture.

17. The retrofit LED linear lamp lampholder of claim 15, wherein the engagement mechanism at the second ends of each endcap is selected from the group consisting of a magnet, non-slip pad material, and self-stick adhesive pads.

18. The retrofit LED linear lamp lampholder of claim 15, wherein the mechanism that moves the second end of at least one of the two endcaps comprises a spring.

19. A retrofit LED linear lamp lampholder for use with LED linear lamps having two terminal ends and used in lighting fixtures having spaced apart opposing end walls, the retrofit LED linear lamp lampholder comprising:

a pair of endcaps, each endcap having a first end that fits on one of the terminal ends of a LED linear lamp, the first end having electrical contacts that connect with electrical pins on the LED linear lamp and the electrical contacts having lead wires that exit the endcaps, and a second end that is adapted to contact with one of the end walls of the lighting fixture; and in at least in one of the endcaps, a movement mechanism for moving said second end of said at least one endcap away from its associated terminal end of LED linear lamp.

20. The retrofit LED linear lamp lampholder of claim 19, further comprising an engagement mechanism at the second ends of the endcaps, which engagement mechanism will aid in retaining the endcaps into contact with the spaced apart opposing end walls of the lighting fixture to thereby retain the associated LED linear lamp in place in the lighting fixture.

21. The retrofit LED linear lamp lampholder of claim 20, wherein the least one of the endcap with the movement mechanism movably fits on the terminal end of LED linear lamp.

22. The retrofit LED linear lamp lampholder of claim 19, wherein the least one of the endcap with the movement mechanism comprises a spring positioned inside the endcap which biases the second end of said at least one endcap away from its associated terminal end of LED linear lamp.

23. The retrofit LED linear lamp lampholder of claim 20, wherein the engagement mechanism at the second ends of each endcap is selected from the group consisting of a magnet, non-slip pad material, and self-stick adhesive pads.

24. The retrofit LED linear lamp lampholder of claim 19, wherein the endcaps each comprise a first portion and a second portion, the first portion and second portion being movable relative to each other, the first portion comprising the first end that fits on one of the terminal ends of the LED linear lamp, and the second portion comprising the second end that has the engagement mechanism.

25. The retrofit LED linear lamp lampholder of claim 19, wherein the second portion moves outwardly away from first portion by a threading mechanism consisting of threads formed on the first portion and second portion, a racket mechanism between the first portion and the second portion, and a spring between the first portion and the second portion.

* * * * *